US007191479B1

(12) United States Patent
Cheng

(10) Patent No.: US 7,191,479 B1
(45) Date of Patent: Mar. 20, 2007

(54) HOSPITAL BED CAPABLE OF CHANGING BED SHEET WITHOUT MOVING THE PATIENT

(76) Inventor: Xiao-Zhou Cheng, Xingye Road, Xingye Garden, Xingye Ge 401, Xiang Zhou District, Zhuhai, Guangdong (CN) 519000

( * ) Notice: Subject to any disclaimer, the term of this patent is extended or adjusted under 35 U.S.C. 154(b) by 0 days.

(21) Appl. No.: 11/353,803

(22) Filed: Feb. 13, 2006

(30) Foreign Application Priority Data

Nov. 15, 2005 (CN) ..... 2005 2 0067292

(51) Int. Cl.
*A61G 7/047* (2006.01)
*A61G 7/00* (2006.01)

(52) U.S. Cl. ..... 5/600; 5/488

(58) Field of Classification Search ..... 5/600, 5/488, 81.1 R, 482, 613
See application file for complete search history.

(56) References Cited

U.S. PATENT DOCUMENTS 3,343,183 A * 9/1967 Sannes ..... 5/488
3,946,450 A * 3/1976 Staggs ..... 5/488
4,926,513 A * 5/1990 Oats ..... 5/488
6,006,378 A * 12/1999 Hayashi ..... 5/488
6,363,555 B1 * 4/2002 LaRose ..... 5/600

* cited by examiner

*Primary Examiner*—Alexander Grosz
(74) *Attorney, Agent, or Firm*—Chen Yoshimura LLP

(57) ABSTRACT

A hospital bed that changes bed sheets without moving the patient. It is composed of a bedstead (including a headboard, a footboard and a bed frame), a deformable bed top, a spool rack and roller shafts on both sides; the ends of the deformable bed top are fixed on the headboard and footboard respectively, and the bed top is pressed into between the roller axles by the spool rack which forms a tightened and leveled bed top that is sunken in the spool rack. Two bed sheets cover the bed, extending respectively from headboard and footboard into the spool rack and rolling on a roller axle. The roller axles and roller shafts are parallel to the cross section of the bed, and are movable between the headboard and footboard with the spool rack. When the spool rack is moving, one bed sheet is spread, another one is rolled up automatically.

10 Claims, 4 Drawing Sheets

904
703

904

902
903

102

905
9

301
305

304

305

301
304

304
301

HOSPITAL BED CAPABLE OF CHANGING BED SHEET WITHOUT MOVING THE PATIENT

BACKGROUND OF THE INVENTION

1. Field of the Invention

This invention relates to a hospital or nursing bed, and especially to a hospital or nursing bed that changes bed sheets automatically without moving the patient.

2. Description of the Related Art

Existing hospital beds, including various kinds of hospital beds, must be vacated before changing bed sheets. The disabled and some patients can't leave the bed without the help of others. This is a hardship for patient family members and the nurses, and more importantly, it may cause pain and discomfort to the patients. For those who are injured in the cervical vertebra or the vertebra, suffering from various kinds of serious injuries, and patients recovering from a surgery, it often causes second injury if the patient is moved and hinders patient recovery.

SUMMARY OF THE INVENTION

Accordingly, the present invention is directed to a hospital that substantially obviates one or more of the problems due to limitations and disadvantages of the related art.

An object of the present invention is to provide a hospital bed that changes bed sheets automatically without moving the patient.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a hospital bed capable of changing bed sheets without moving a patient thereon, which includes: a bedstead including a headboard, a footboard and a bed frame; a deformable bed top; and a spool rack with two roller shaft on both sides, the spool rack being mounted on the bed frame and moveable in a longitudinal direction of the bed, wherein two ends of the deformable bed top are fixed on the headboard and footboard, respectively, and the deformable bed top is pressed down between the roller shafts by the spool rack to form a tightened and leveled bed top that is sunken in the spool rack, wherein the spool rack includes two demountable roller axles each for rolling a bed sheet thereon, and wherein the roller axles and roller shafts are parallel to a transverse direction of the bed, and movable in the longitudinal direction between the headboard and the footboard with the spool rack.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
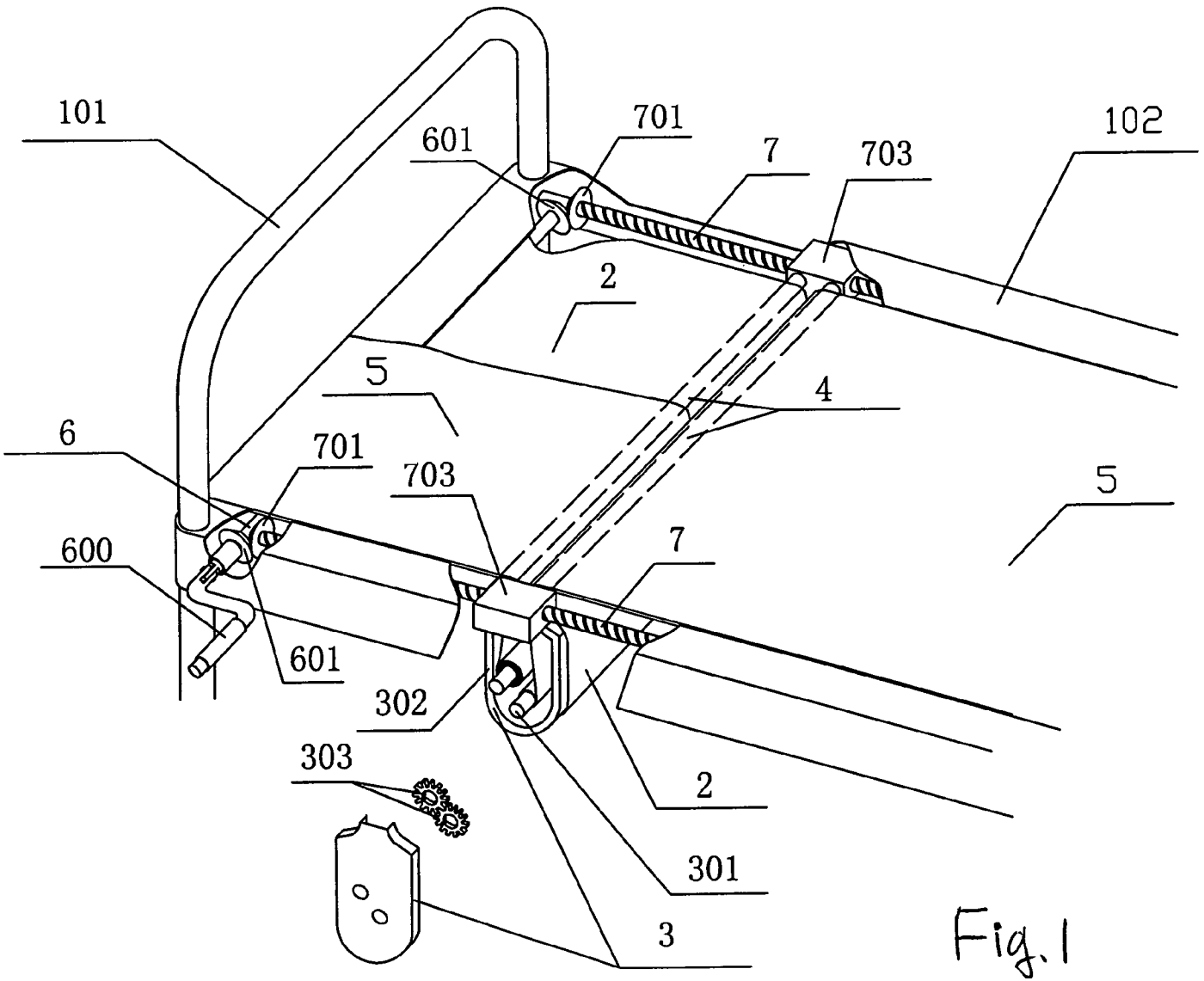
FIG. 1 shows an embodiment of the present invention.

The technical problem solved by this invention is how to overcome the shortcomings of the existing technology and offer a hospital bed that changes the bed sheet automatically without moving the patient.

In order to solve above-mentioned technological problems, a hospital bed that changes the bed sheet automatically without moving the patient according to embodiments of the present invention has a bedstead (including a headboard, a footboard and a bed frame), a deformable bed top, a spool rack and a roller shaft on both sides The two ends of the deformable bed top are fixed on the headboard and footboard, respectively, and the bed top is pressed into between the roller shafts by the spool rack which forms a tightened and leveled bed top that is sunken in the spool rack. Two demountable roller axles are installed in the spool rack. Two bed sheets cover the bed, extending into the spool rack and rolled on a roller axle respectively from headboard and footboard. The roller axles and roller shafts are parallel to a transverse direction of the bed top, and are movable in a longitudinal direction between the headboard and footboard with the spool rack. When the spool rack is moved, a bed sheet is spread, and another is rolled up automatically. A key feature of this bed is that part of the deformable bed top can go underneath the bed and result in a movable concave space in the spool rack which allows the roller axles to roll up or spread the bed sheet in this space. In such a design, it is not necessary to move the injured and patients to change bed sheets. A roller axle with the clean sheet will be installed on the corresponding position in the spool rack. The clean bed sheet will be spread and the old one will be rolled up automatically when the spool rack is moved. The bed sheet is changed when the spool rack is moved from one end of the bed to another.

Preferably, the cover of the spool rack has a shell with a "U" cross section, the interface between the shell and the deformable bed top is polished. Alternatively rollers are installed between the spool rack and the deformable bed top, i.e. underneath and on both sides of the spool rack. In such a design, the friction can be smaller when the spool rack is moved.

In another embodiment of this invention, there are longitudinal screws on the two long arms (commonly called "bedsides") of the bed frame, such that when the spool rack is moved, the longitudinal screws drive one roller axle to outspread the clean bed sheet, and another to roll up the used bed sheet. For the hospital bed with one end that can be raised up as a backrest, the two long arms of the bed frame and the longitudinal screws should be composed of two folding sections and built with a lifting mechanism. In such a design, one of the roller axles will be driven through the longitudinal screws to be engaged to the other roller axle to perform a reliable operation.

Preferably, one end of the respective bed sheet is fixed on the headboard or footboard, the other end of the bed sheet is wounded around one of the two roller axles that rotate in different directions respectively. The roller axles are engaged through a pair of engaging gears. In such a design, when the spool rack is moved, a bed sheet is spread, pulling the roller axle it is wound around to rotate, therefore driving the other roller axle to roll up another bed sheet through a pair of engaging gears.

Preferably, outside each roller axle, there is a spiral torsion spring, outside of which is another roller. One end of the spiral torsion spring is fixed on the roller axle; the other end is fixed on the outside roller. When the spool rack is moving, one bed sheet spreads, with the spiral torsion spring pressed to accumulate energy while another bed sheet rolls up with the energy released by the transformed spiral torsion spring. In such a design, the bed sheet is rolled up automatically by the spiral torsion spring.

Preferably, there is a crankshaft that lies in the headboard or footboard of the bed, on which two driving bevel gears are designed. There are longitudinal screws on the two long arms of the bed frame (commonly called "bedsides") separately, with driven bevel gears on the longitudinal screws. The driving bevel gears and driven bevel gears make up two pairs of occluding bevel gears, so when the handle is turned, the two longitudinal screws move synchronously. There are two nuts working with the longitudinal screws installed respectively at both ends of the spool rack. The crankshaft can also be driven by an electrical motor. In such a design, the bed sheet can be simply changed by rotating the crank handle.

Preferably, apart from both ends of the spool rack, the two long arms of the deformable bed top can be joined with the bed frame by longitudinal zippers. Both ends of the spool rack have a pair of opposite zipper locks, when the spool rack is moved, the front zipper lock unzips one zipper and the back zipper lock zips the other zipper. In such a design, the hospital bed has a simple structure that is easy to use, and is more leveled and durable.

Preferably, the deformable bed top are furnished with several rails, of which slots are opened on both ends, while the same number of male tabs with reset springs are positioned on the two long arms of the bed frame correspondingly. Each male tab has a peg and each nut has a slide groove, the peg, the bed frame and the slide groove of a nut form a wedge cam mechanism. When a peg comes to the middle of a slide groove, the male tab inserts into the slot under the pressure of the reset spring. Without the slots, the male tabs can insert directly beneath the rail ends.

In such a design, the hospital bed has a simple structure that is easy to use, and is more leveled and durable.

Preferably, there is a mattress between the bed sheet and the deformable bed top, which is adhered to the deformable bed top. If this mattress is inflatable, it can be installed unto the demountable roller axle of the spool rack the same as the bed sheet. An annular groove is designed in the midsection of the roller shaft. In such design, the hospital bed is softer and more comfortable. The mattress, just as the bed sheet, is installed unto the demountable roller axle of the spool rack so as to be changed easily. It adheres to the deformable bed top, and is easy to use with a simple structure.

Preferably, there are three pipes set between the two roller shafts; the pipe in the middle is used to spray water and the two on both sides are for jet wash. In such a design, it is easy to clean and massage the back of the patient.

By adopting above-mentioned technological schemes, a hospital bed that changes the bed sheet automatically without moving the patient according to embodiments of the present invention has the advantage of a simple structure and easy use, is suitable for the paralyzed patients, VS patients, those severely injured, patients of serious illness and patients recovering from a surgery or people not suitable to move. This invention can help the nurses and the patient family members to change bed sheets, and without causing any harm or pain to the patient, hence fundamentally solves a long existing problem for medical personnel and patients.

The embodiments of the present invention about a hospital bed that changes the bed sheet automatically without moving the patient will be further illustrated with the attached figures:

Embodiment 1

As shown in FIG. 1, the bed has a bedstead 1 (including headboard 101, footboard and bed frame 102), a deformable bed top 2, a spool rack 3 and a roller shaft 4 on both sides. The two ends of the deformable bed top 2 are fixed on the headboard 101 and footboard respectively, and the bed top is pressed into between the roller shafts 4 by the spool rack 3 and forms a tightened and leveled bed top that is sunken in the spool rack 3. Two demountable roller axles 301 are installed in the spool rack 3. Two bed sheets 5 cover the bed, extending into the spool rack 3 and rolled on roller axles 301 respectively from headboard 101 and footboard. The roller axles 301 and roller shafts 4 are parallel to a transverse direction of the bed top, and are movable in a longitudinal direction between the headboard 101 and footboard with the spool rack 3. When the spool rack 3 is moved, a bed sheet 5 is spread, and another bed sheet 5 is rolled up automatically. A key feature of this bed is that part of the deformable bed top 2 can go beneath the bed and result in a movable concave space that allows the roller axle 301 to roll up or spread the bed sheet in this space. It also includes a crankshaft 6 that lies in the headboard 101 of the bed. Two driving bevel gears 601 are designed for the crankshaft 6. There are longitudinal screws 7 separately on the two long arms of the bed frame 102 (commonly called "bedsides"). There are driven bevel gears 701 on the longitudinal screws 7. The driving bevel gears 601 and driven bevel gears 701 make up two pairs of engaging gears, moving the crankshaft 6 and the two longitudinal screws 7 synchronously. Nuts 703 working with the longitudinal screws 7 are installed respectively at the two ends of the spool rack 3. With the rocking handle 600 of the crank handle 6 removed, the crankshaft can be driven by an electrical motor.

The cover of the spool rack 3 has a shell 302 with a "U" cross section, the interface between the shell 302 and the deformable bed top 2 is polished to reduce the friction between the spool rack 3 and the deformable bed top 2. Alternatively, if roller shafts are provided between the spool rack 3 and the deformable bed top 2, i.e. underneath and on both sides of the spool rack 3, the friction will be even smaller.

One end of the bed sheet 5 is fixed on the headboard 101 or footboard, the other end of the bed sheet is wound around one of the two roll axles 301 rotating in different directions respectively. The roller axles 301 are engaged through a pair of engaging gears 303. When the spool rack 3 is moved, a bed sheet is spread, pulling the roller axle it is wound around to rotate, driving the other roller axle to roll up another bed sheet through the pair of engaging gears 303. If longitudinal screws 7 are installed on the two long arms (commonly called as "bedsides") of the bed frame 102, the gear mechanism also can drive the roller axle 301. When the spool rack 3 is moved, this longitudinal screw drives one roller axle 301 to outspread bed sheet 5, and another roller axle 301 to roll up bed sheet 5. For the hospital bed with one end that can be raised up as a backrest, the two long arms of the bed frame 102 and longitudinal screws should be composed of two folding sections and built with lifting mechanism.

Embodiment 2

Figure 2:
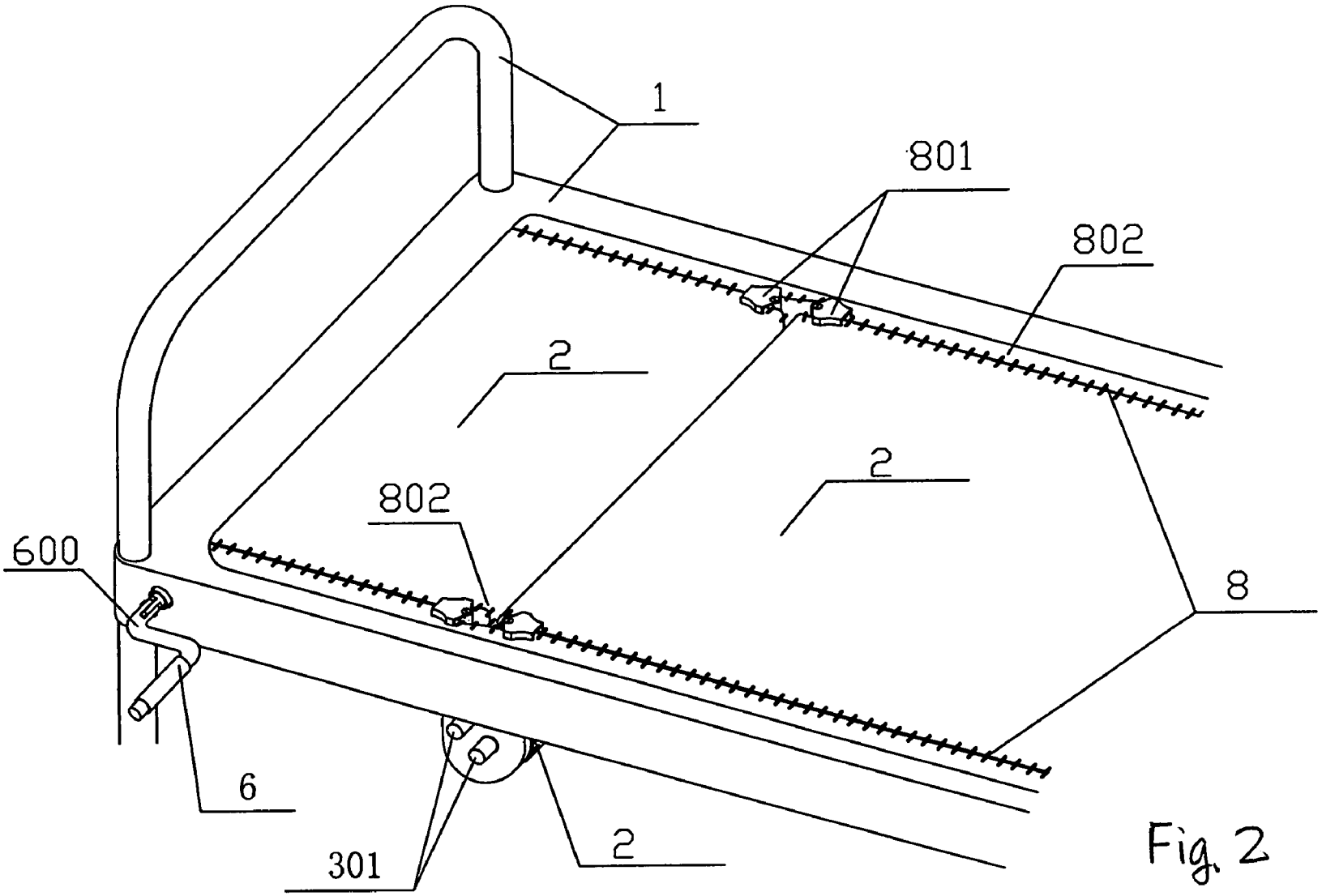
FIG. 2 shows another embodiment of the present invention (bed sheet not included).
Figure 3A:
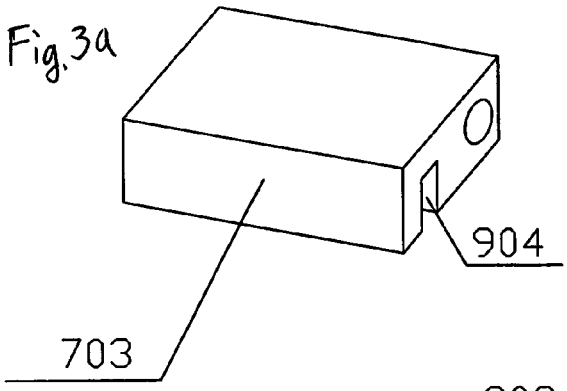
FIGS. 3*a–e* show another embodiment of the present invention (A is the schematic view of the nut section).
Figure 3B:
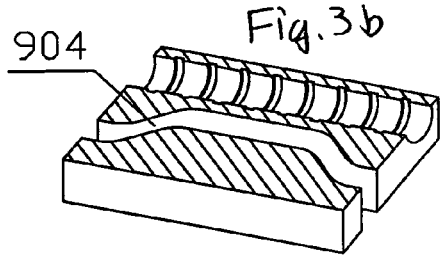
Figure 3C:
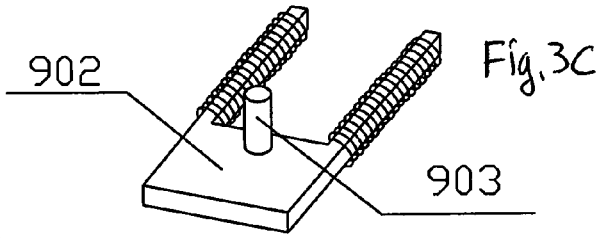
Figure 3D:
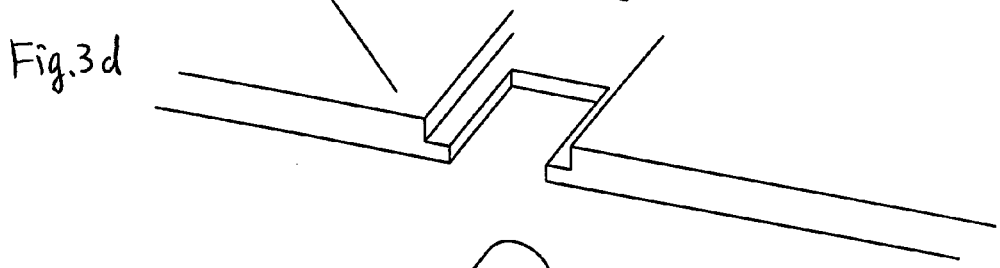
Figure 3E:
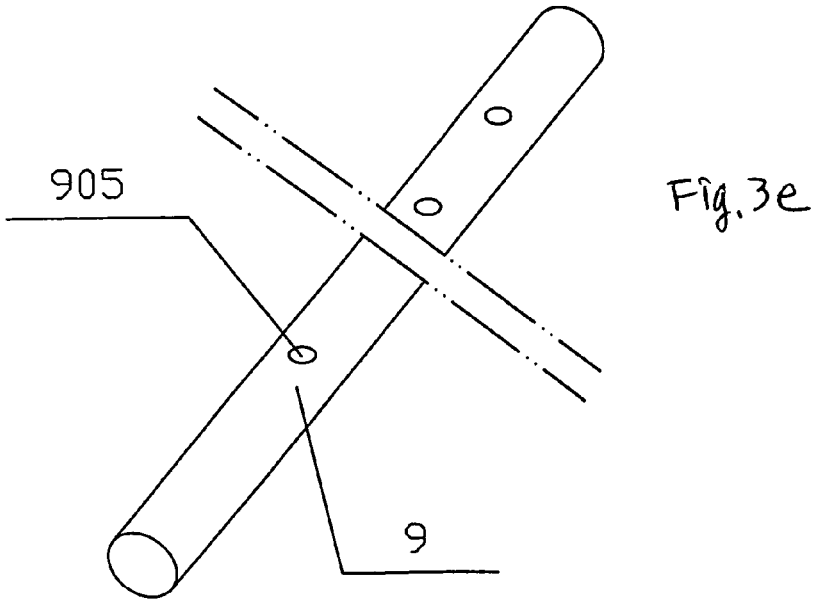
Figures 4A, 4B, 4C, 4D, 4E:
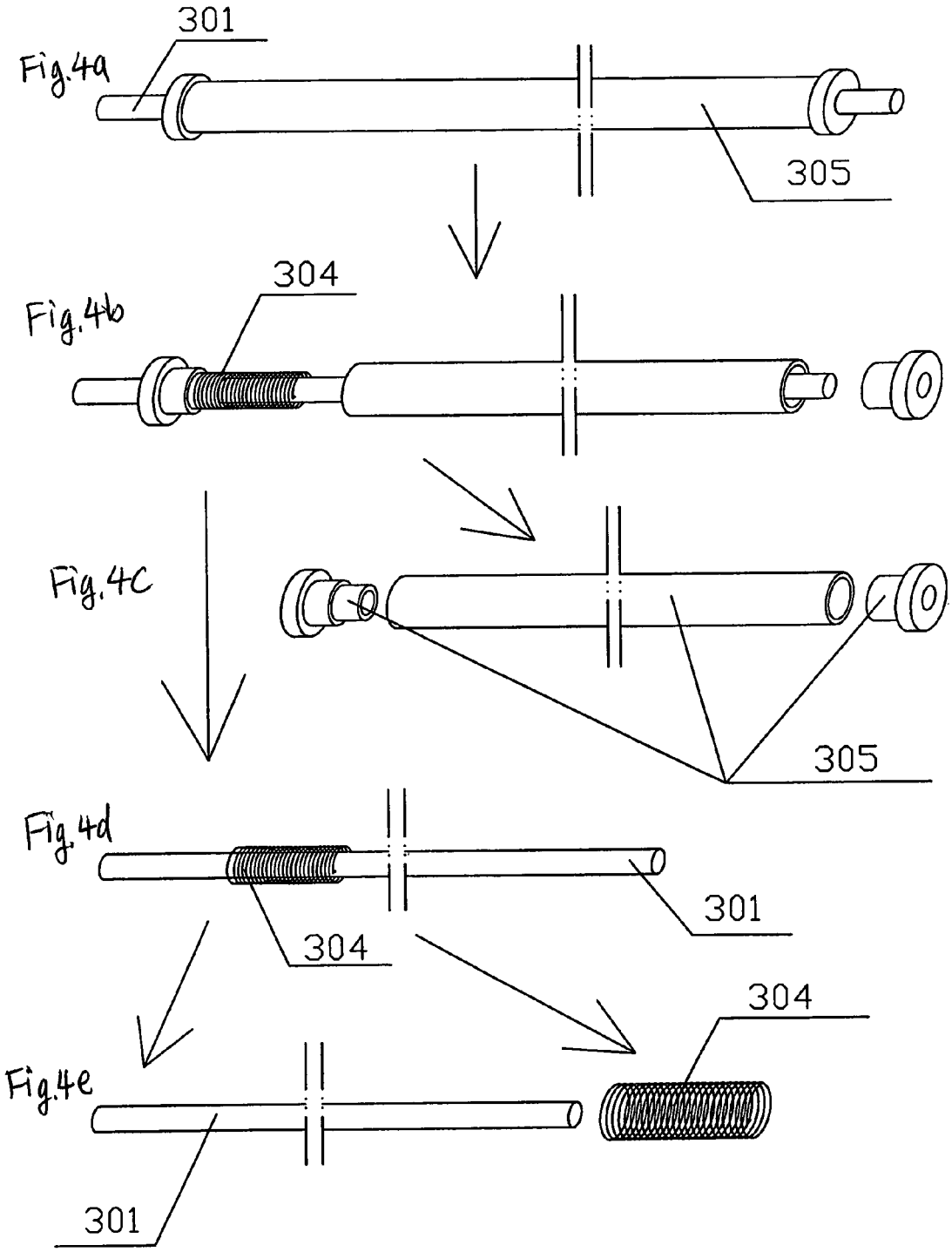
FIGS. 4*a–e* show the roller axles, spiral torsion springs and the roller in an embodiment of the present invention.

As shown in FIG. 2, apart from both ends of the spool rack 3, the two long arms of the deformable bed top 2 are joined with the bed frame 102 by the longitudinal zippers 8; Both ends of the spool rack have opposite zipper locks 801. When the spool rack 3 is moved, the front zipper locks unzips the zipper belts 802 and the back zipper locks zip the zipper belts together. The rest of the components and structure are the same as stated in Embodiment 1.

Embodiment 3

As shown in FIGS. 3*a–e*, the deformable bed top is installed with a plurality of transverse rails 9, while the two long arms of the bed frame 102 are installed with the same number of male tabs 902 correspondingly with reset springs. Each male tab 902 has a peg 903 and each nut 703 has a slide groove 904. The peg 903, the bed frame 102 and the slide groove 904 of a nut 703 form a wedge cam mechanism. When the peg 903 comes into the middle of the slide groove 904, the male tab 902 exits the under part of the end of a rail 9. When the peg 903 comes out of the middle of the slide groove 904, the male tab 902 inserts into the under part of the rail 9 under the pressure of the reset spring. The rest of the components and structure are the same as stated in Embodiment 1. In this embodiment, the rails function to bear most of the weight of the patient. When combined with a mattress (see embodiment 5), such a bed is strong and comfortable.

Embodiment 4

As shown in FIGS. 4*a–e*, around the roller axle 301, there is a spiral torsion spring 304, which has an outer cylinder 305 outside. One end of the spiral torsion spring 304 is fixed on the roller axle 301, the other end is fixed on the cylinder 305. When the spool rack 3 is moving, one bed sheet 5 outspreads, with the spiral torsion spring 304 deformed to accumulate energy, while another bed sheet 5 rolls up with the energy released by the corresponding spiral torsion spring that is previously deformed. The rest of the components and structure are the same as stated in Embodiment 1.

Embodiment 5

There is an inflatable mattress between the bed sheet and deformable bed top which is adhered to the deformable bed top 2; an annular groove is designed in the midsection of the roller shaft 4. The rest of the components and structure are the same as stated in Embodiment 1. (Fig. Omitted)

Embodiment 6

There are three pipes set between the two roll shafts 4, the pipe in the middle is used to spray water and the two on both sides are for jet wash. The rest of the components and structure are the same as stated in Embodiment 1. (Fig. Omitted)

Although the bed has been referred to as a hospital bed, its use is not limited to hospitals. It can also be used at homes, in nursing homes, etc.

It will be apparent to those skilled in the art that various modifications and variations can be made in the hospital bed of the present invention without departing from the spirit or scope of the invention. Thus, it is intended that the present invention cover modifications and variations that come within the scope of the appended claims and their equivalents.

What is claimed is:

1. A hospital bed capable of changing bed sheets without moving a patient thereon, comprising:

a bedstead including a headboard, a footboard and a bed frame;

a deformable bed top; and a spool rack with a roller shaft on each side, the spool rack being mounted transversely on the bed frame and moveable in a longitudinal direction of the bed, wherein two ends of the deformable bed top are fixed on the headboard and footboard, respectively, and the deformable bed top is pressed down between the roller shafts by the spool rack to form a tightened and leveled bed top that is sunken in the spool rack, wherein the spool rack includes two demountable roller axles each for rolling a bed sheet thereon, and wherein the roller axles and roller shafts are parallel to a transverse direction of the bed, and movable in the longitudinal direction between the headboard and the footboard with the spool rack.

2. The hospital bed of claim 1 wherein the spool rack has a cover shell with a U shaped cross section, the surface of the shell facing the deformable bed top being polished.

3. The hospital bed of claim 1, wherein the bed frame includes two longitudinal screws on two long arms thereof, wherein when the spool rack is moving, the longitudinal screws drive the two roller axles to rotate.

4. The hospital bed of claim 1, further comprising two bed sheets, wherein one end of each bed sheet is fixed on the headboard and the footboard, respectively, and the other end of each bed sheet is wound around a roller axle, respectively, in different directions.

5. The hospital bed of claim 1, wherein the spool rack further includes a spiral torsion spring disposed outside of each roller axle and an outer cylinder disposed outside of each spiral torsion spring, wherein one end of each spiral torsion spring is fixed on the respective roller axle and the other end of it is fixed on the respective outer cylinder, wherein when two bed sheets are wound on the two roller axles and the spool rack is moving, one bed sheet spreads out to deform the corresponding spiral torsion spring to accumulate energy while the other bed sheet rolls up under the energy released by the corresponding spiral torsion spring which is previously deformed.

6. The hospital bed of claim 1, further including:

a crankshaft in the headboard or the footboard;

two driving bevel gears on the crankshaft;

two longitudinal screws on two long arms of the bed frame;

two driven bevel gears on the longitudinal screws, wherein the two driving bevel gears and two driven bevel gears form two pairs of occluding bevel gears to rotate the two longitudinal screws synchronously when the crankshaft rotates; and two nuts at both ends of the spool rack engaged with the longitudinal screws.

7. The hospital bed of claim 1, further comprising:

two longitudinal zippers joining two longitudinal sides of the deformable bed top with the bed frame, including a pair of opposite zipper locks for each zipper, wherein each end of the spool rack is connected to a pair of opposite zipper locks, wherein when the spool rack is moving, one zipper lock of the pair of zipper locks unzips a section of the corresponding zipper and the other zipper lock zips another section of the corresponding zipper.

8. The hospital bed of claim 1, further comprising:

a plurality of transverse rails with slots on both ends of each rail, a plurality of male tabs with reset springs disposed on two long arms of the bed frame corresponding to the rails, each male tab having a peg; and two nuts at the ends of the spool rack, each nut having a slide groove, wherein a peg, the bed frame and a slide groove of a nut form a wedge cam mechanism, wherein when a peg comes to the middle of the slide groove, the corresponding male tab inserts into the slot under the pressure of the corresponding reset spring.

9. The hospital bed of claim 1, further comprising a mattress adhered to a top surface of the deformable bed top.

10. The hospital bed of claim 1, further comprising a plurality of pipes disposed between the two roller shafts for spraying or jetting water for a jet wash.

* * * * *